US007032521B2

(12) United States Patent
Ronn et al.

(10) Patent No.: US 7,032,521 B2
(45) Date of Patent: Apr. 25, 2006

(54) CARGO UNIT FOR SUBMUNITIONS

(75) Inventors: Torsten Ronn, Karlskoga (SE); Ulf Heiche, Karlskoga (SE)

(73) Assignee: BAE Systems Bofors AB, Karlskoga (SE)

( * ) Notice: Subject to any disclaimer, the term of this patent is extended or adjusted under 35 U.S.C. 154(b) by 0 days.

(21) Appl. No.: 10/312,977

(22) PCT Filed: Jun. 21, 2001

(86) PCT No.: PCT/SE01/01431

§ 371 (c)(1),
(2), (4) Date: Aug. 20, 2003

(87) PCT Pub. No.: WO02/03018

PCT Pub. Date: Jan. 10, 2002

(65) Prior Publication Data

US 2004/0139877 A1 Jul. 22, 2004

(30) Foreign Application Priority Data

Jul. 3, 2000 (SE) ..... 0002486

(51) Int. Cl.
*F42B 12/58* (2006.01)

(52) U.S. Cl. ..... 102/489

(58) Field of Classification Search ..... 102/393, 102/489

See application file for complete search history.

(56) References Cited

U.S. PATENT DOCUMENTS

| | | | | |
|---|---|---|---|---|
| 3,938,438 A | | 2/1976 | Anderson et al. | |
| 3,980,019 A | | 9/1976 | Anderson et al. | |
| 4,029,016 A | * | 6/1977 | Cole | 102/489 |
| 4,638,736 A | * | 1/1987 | Farmer | 102/393 |
| 4,799,429 A | * | 1/1989 | LaBudde et al. | 102/393 |
| 4,998,480 A | * | 3/1991 | Denis et al. | 102/393 |
| 5,429,052 A | * | 7/1995 | Bross et al. | 102/217 |
| 6,244,184 B1 | * | 6/2001 | Tadmor | 102/266 |

FOREIGN PATENT DOCUMENTS

| | | | |
|---|---|---|---|
| DE | 3048618 A1 | | 7/1982 |
| DE | 3326877 A1 | * | 2/1985 |
| DE | 3920016 A1 | | 1/1991 |
| EP | 0961098 A2 | | 12/1999 |
| FR | 2135411 | | 12/1972 |

* cited by examiner

*Primary Examiner*—Michael Carone
*Assistant Examiner*—Troy Chambers
(74) *Attorney, Agent, or Firm*—Connolly Bove Lodge & Hutz, LLP; Larry J. Hume

(57) ABSTRACT

A selectable mode multi-mode missile carrying submunitions and incorporating guidance and target seeking functions includes triggering or actuation of the submunitions by programming function on the ground or on board another weapon platform or via a link from the ground or said the weapon platform. The submunitions may also be actuated by an impact function. The programming function incorporates or interacts with mode determining or setting devices that cause the missile and its submunitions to selectively operate either in a penetrator mode, a distributed penetrator mode, or in a separation mode. The submunitions are actuated independently, in sequence, or in common with each other depending upon the operating mode selected.

17 Claims, 6 Drawing Sheets

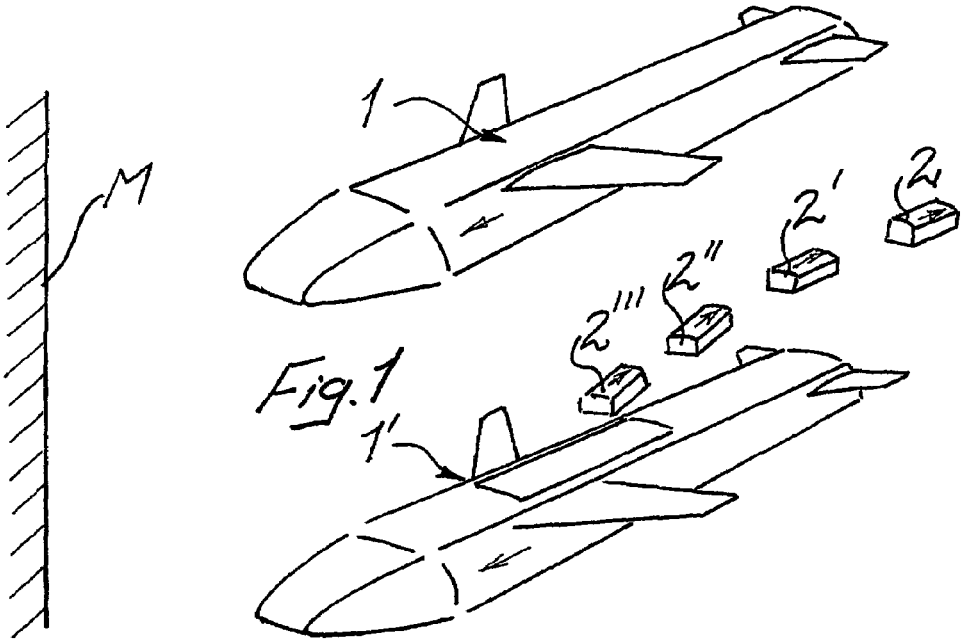
Fig. 1
Fig. 2
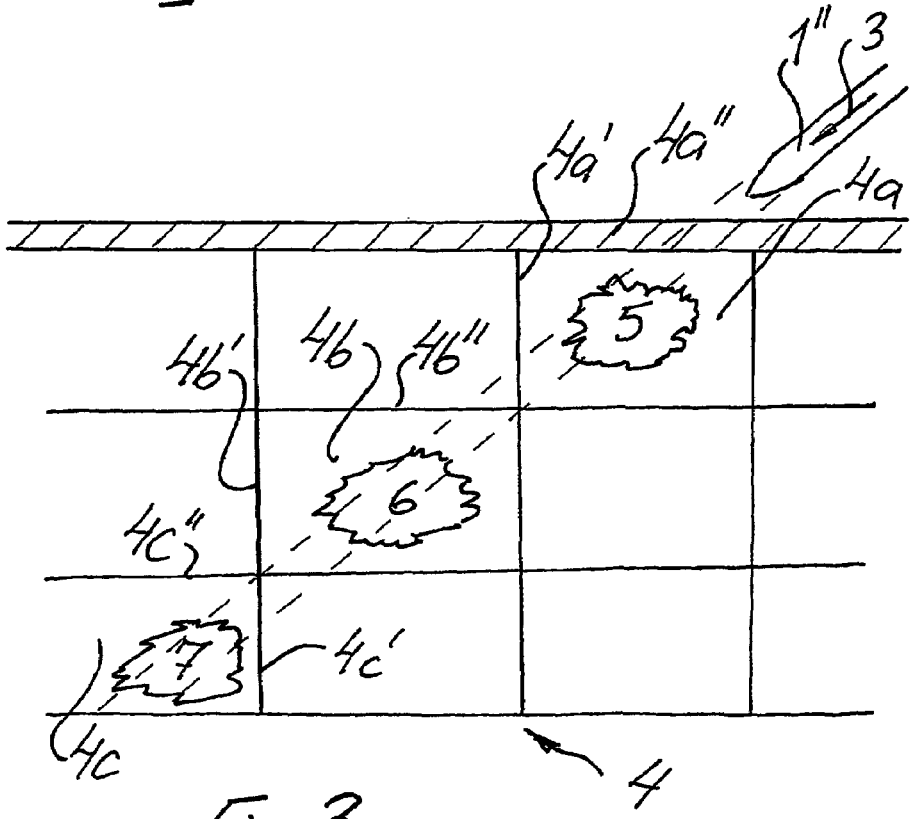
Fig. 3

CARGO UNIT FOR SUBMUNITIONS

BACKGROUND

The present invention relates to a cargo device that carries a number of submunitions whereby the cargo device is preferably equipped with guidance and/or target seeking functions and may constitute a missile or a missile or equivalent, launchable from a ramp or other weapon platform in the form of, for example, an aircraft. The triggering or actuation of the submunitions carried shall then be determinable by a programming function on the ground or on board the weapon platform in question, such as an aircraft, or via a fixed or wireless communication link from the ground or on board said weapon platform. The submunitions shall, moreover, be actuatable either individually or jointly by means of or via an impact function, proximity fuze, remote triggering, or by another admittedly known triggering device.

The designing of missiles and other ammunition or cargo-bearing devices so that they are specially suited to combating targets or situations of a certain given type is previously known. This means that the ammunition or warhead designed for a specific type of target is often completely unsuitable for combating a different type of target, and vice versa Such dedicated ammunition units are already well known and exist in a multitude of designs, among other things because of the above mentioned target type dedication. This can be referenced in the patent literature in the field.

There is a general need to be able to reduce the assortment of weapon borne ammunition units without losing the desired effectiveness against each type of target or combat situation. The measures and ammunition units proposed must also satisfy the stringent requirements pertaining to handling, service and storage, and the matter must be characterised by singularity of purpose while safety during handling and operation must not be neglected. The objective of the present invention is to resolve this problem completely or partially.

SUMMARY

The feature that can be considered to be the main characteristic for the initially mentioned cargo device is, among other things, that the programming function incorporated comprises or interacts with mode determining devices which, for example, dependent on at least one manual or automatic actuation enables the cargo device and its submunitions to act either jointly in a penetrator mode in which the submunitions are at least essentially conjoined in a joint triggering or actuation function, or in a separation mode in which the submunitions sequentially exit their cargo space in the device and subsequently function via an individual triggering or actuation function whereby the said triggering or actuation function in each submunition can be independent of or coordinated with the triggering or actuation function of the other submunitions. In principle the same submunitions can be utilised in either mode. Alternatively, the direction of the submunitions can be determined on the ground before the cargo device starts its journey to the target, whereby the submunitions are further matched to the target and are arranged to be either conjoined in the device or for dispersal from the device according to the mode employed.

The basic principle behind the present invention is thus—as the expressions 'penetrator mode' and 'separation mode' indicate—that if penetrator mode is selected all the submunitions shall be tightly conjoined to form a single body whose combined effect provides good penetration capability in hard targets such as bunkers and which, when the cargo device reaches the target and more or less itself disintegrates against the target the conjoined submunitions continue into the target where they detonate and blow up the target from inside, or blow up the target on impact. Implementation of the penetrator mode involving a pure penetration of the target and no detonation of the submunitions until inside the target presupposes that the conjoined submunitions have a reinforced nose section which, by means of its inherent hardness and the kinetic energy acquired from the cargo device, is able to penetrate the target.

Should the reinforced nose section of the submunitions not be capable of penetrating the target, all submunitions detonate on impact with the target.

In one design version of the invention concept the mode determining devices—dependent on an additional actuation—can even be arranged to enable the cargo device and its submunitions to operate with a distributed penetrator mode in which the submunitions achieve a minor sequential dispersal and are actuated as penetration of the target progresses.

In its other main variant—separation mode—the submunitions are dispersed on command over a pre-determined target zone, and each submunition is thus actuated by its own initiation device that can be time controlled, point detonating, or have its own elementary target seeker or proximity fuze. The separation mode can be a good alternative when engaging enemy forces attacking in light armour vehicles, for example. In this variant the cargo device can even continue its flight after releasing all its submunitions. In this case the dedicated, joint nose section for penetrator mode remains in the cargo device. Dispersal of the submunitions utilises already known techniques.

Additional design versions of the present invention are disclosed in the subsequent patent claims.

The above proposals enable major technical and financial benefits by enabling a substantial reduction in the diverse range of submunition cargo devices. Well proven technical methods are used in this respect for the realisation of the present invention which means that current handling and service functions can be utilised and safety requirements can be met. As claimed in the present invention the position of the submunitions in their space in the cargo device is controlled to enable the penetrator and separation modes to be implemented. This can, of course, be achieved by using already known techniques, which further contributes to the above mentioned technical and financial benefits.

Various aspects of this disclosure relate to a cargo device (1) for submunitions (2) that is preferably equipped with guidance and/or target seeking functions (8, 9), such as a missile, where the triggering or actuation of the submunitions is determinable by means of a programming function on the ground or on board another weapon platform (aircraft) or via wireless link from the ground or said other platform. The submunitions moreover are actuatable by impact function and/or proximity fuze function or time function wherein the programming function (22) incorporates or interacts with mode determining devices (18,19, 20,21) which, dependent on at least one manual or automatic actuation, cause the cargo device (1) and its submunitions (2) to operate either in a penetrator mode in which the submunitions are essentially conjoined in a common triggering or actuation function, or in a separation mode in which the submunitions sequentially leave the said cargo device and thereafter function by means of an individual triggering or actuation function, each of which is either independent from or coordinated with the triggering or actuation functions of the other submunitions.

As is conventionally known in ordnance design, and as described above, submunitions may be actuated by an impact function, e.g., an impact fuze, or using a time function, e.g., a time fuze.

BRIEF DESCRIPTION OF THE DRAWING

Some of the currently proposed design forms for a cargo device displaying characteristics that are significant for the present invention are described below with reference to the appended FIGS. 1–10 in which FIG. 1 shows a general view from the side of a cargo device in the form of a missile flying towards a target whereby the missile is operating in a penetrator mode where, for example, a hole shall be effected in the target in question, FIG. 2 is a general side view showing the missile or equivalent in a separation mode which the missile can assume as an alternative to the penetrator mode shown in FIG. 1, whereby the missile in separation mode has started dispensing the submunitions in question over an actual target, FIG. 3 shows a general view from above illustrating a distributed penetrator method in which the missile or equivalent in question penetrates a building or similar target, and during penetration distributes submunitions into the various rooms or confined spaces in the building as penetration occurs, FIG. 8 is a general block diagram showing the programming functions for triggering and separation of the submunitions illustrated in a general manner, while

DETAILED DESCRIPTION

Figure 4:
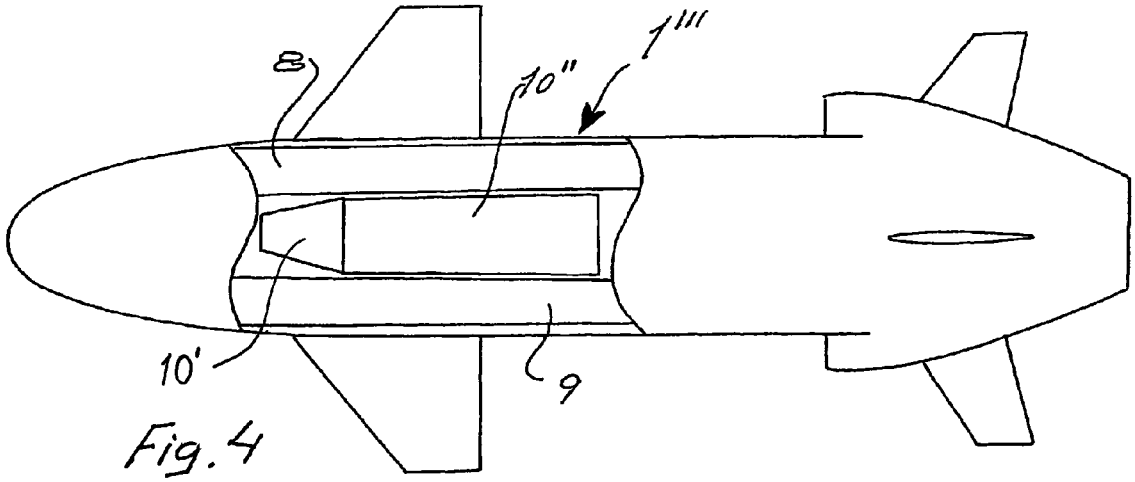
FIG. 4 is a general view from above showing the design of a cargo device in the form of a missile.

Number 1 in FIG. 1 denotes a cargo device in the form of a missile, for example. The basic design of the missile or equivalent is already well known and will not be described herein. FIG. 1 illustrates the case where the missile operates in a penetrator mode, which means that it shall impact with a target M, in the form of a bridge pier for example, and effect a hole in the target. The missile or equivalent carries or contains a number of submunitions 2 of an already known type. The submunitions may comprise explosive charges with possible associated fragment and pellet elements, or submunitions with shaped charge effect, etc. In this case the relation of the submunitions 2 to each other is selected according to the type of target represented by M. In the version illustrated in FIG. 1 the submunitions are conjoined together in the manner characteristic of the penetrator mode. The position of the submunitions inside the cargo device is shown in FIG. 4 by the designation 10" and their joint reinforced nose section 10' is also visible, arranged in front of the submunitions where it is mainly responsible for penetrating the target before the various submunitions detonate inside the target or complete the penetration of the target. The cargo device, which has completed its task by transporting the submunitions to the target, and which does not have the strength or hardness of the said reinforced nose section, will in most cases be simultaneously completely destroyed against the outer wall of the target while the submunitions, preceded by their reinforced nose section 10', thus continue into the target.

FIG. 2 represents in general the same cargo device described in FIG. 1. In this case the missile or equivalent is designated 1'. In the case illustrated in FIG. 2 the missile or equivalent is operating in a separation mode whereby the cargo device when close to the target dispenses submunitions 2, 2', 2", 2''', etc above or adjacent to an actual target such as a military detachment or equivalent that is not illustrated in FIG. 2. The submunitions thereby leave their cargo space inside the missile or equivalent sequentially to enable an effective dispersion over the target in question. The dispersion can be varied via different program modes controlling the release of the submunitions from the missile or equivalent. Such program modes can be achieved by employing an already known method such as time controlled circuits.

FIG. 3 illustrates the case when the cargo device operates with a distributed penetrator method in which the cargo device 1" on an approach path 3 pierces and penetrates a building 4 that can have a number of internal confined spaces or rooms of which rooms 4*a*, 4*b*, and 4*c* are designated on FIG. 3. It can thus be expected that penetration in the target will be performed primarily by the conjoined submunitions preceded by their common reinforced nose section. The said confined spaces in the building are bounded in a known manner by walls etc 4*a*', 4*a*", 4*b*', 4*b*", 4*c*', 4*c*" and so on. When the cargo device penetrates the building, cargo device 1"—or at least the submunitions incorporated—penetrate the said walls etc, and by using other approach paths into building 4 different walls, floors and ceilings can be penetrated. In the distributed penetrator mode as claimed in the present invention the submunitions shall be dispensed into the various rooms or confined spaces 4*a*, 4*b*, 4*c* as the penetration of the building and its various rooms progresses. In FIG. 3 submunitions have been dispensed from the missile into rooms 4*a*, 4*b*, and 4*c* resulting in bursts or triggerings symbolised by 5, 6 and 7.

Figure 5:
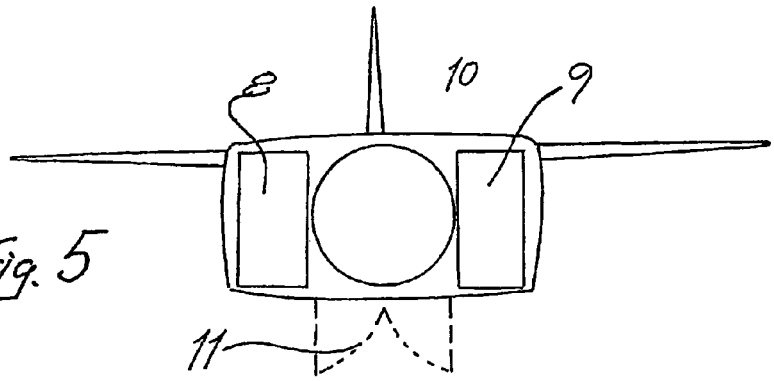
FIG. 5 is a general end view of the missile illustrated in FIG. 4.

FIG. 4 shows a cargo device in the form of a missile 1''' of an already well known type. The missile is equipped with target seeking and guidance system equipment 8, 9, a motor arrangement, control surfaces, etc. As all these components are well known they will not be described in any further detail herein. FIG. 5 shows a stowage compartment 10 for submunitions that can be arranged for external release 11 of submunitions. Control of the triggering or actuation and possible release of the submunitions in distribution or separation modes is described in outline below. The submunitions 10" are located inside the stowage compartment 10 arranged conjoined behind each other and behind the common reinforced nose section 10' located at the front of the said compartment in the direction of flight of the carrier. Thus in penetrator mode they function during penetration of the target as a collective body but which, in distribution mode, is divided into its constituent parts—i.e. the individual submunitions—after which they are dispensed in accordance with the desired dispersion pattern.

Figure 6:
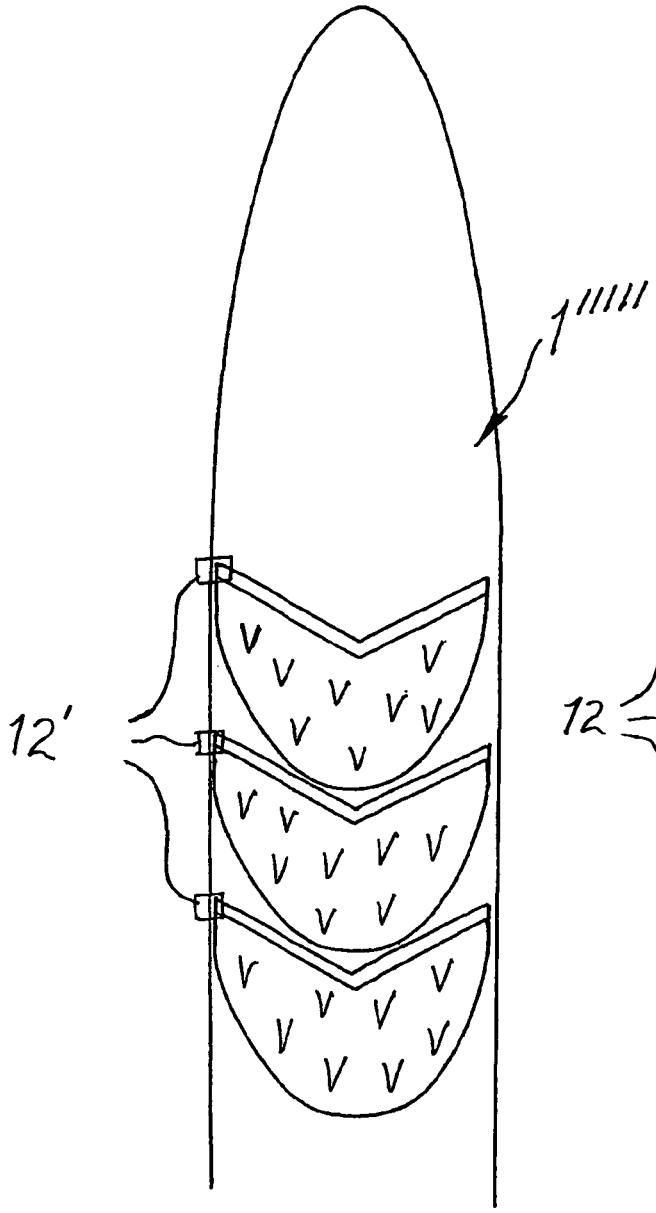
FIG. 6 is a general horizontal view showing the location of submunitions in a missile or other cargo device.
Figure 6:
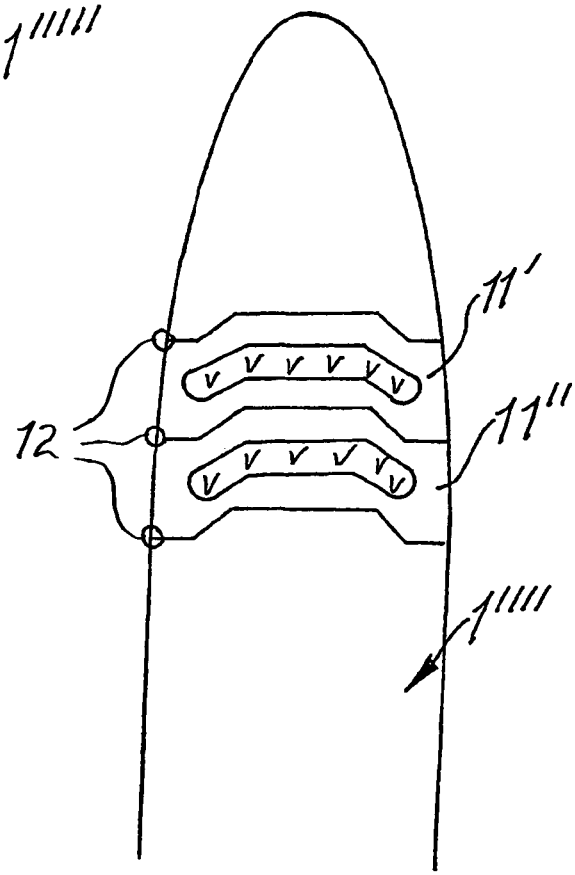

Conjoining of the submunitions in penetrator mode and dispersal in separation mode can be performed manually or electrically. Locking devices can thereby be actuated manually or automatically via electrical control so that either mode can be enabled in conjunction with the cargo device's or vehicle's path towards the target in question. Actuation of the locking devices for locking in penetrator mode or opening in separation mode can be carried out on the ground, by wireless link from the ground, or by the weapon platform carrying the cargo device such as an aircraft, etc. Alternatively, the locking devices can be set or actuated before the cargo device is launched. In an alternative design the cargo device can in principle be loaded with different submunitions whereby the first type of submunitions are so arranged in the cargo device's cargo space that they cannot be separated, or in such a way that they can be separated. Opening of the locking devices and dispersal of the submunitions in the distributed penetrator mode can be performed in a corresponding manner to that for the separation mode. The only difference is that the sequential release of the submunitions from the cargo device shall be with closer intervals. In FIG. 6 two submunitions 11' and 11" are arranged in cargo device 1"". More submunitions are incorporated but are not illustrated in FIG. 6. The submunitions as such can be constructed in an already known manner. In FIG. 6 the submunitions are conjoined by symbolically designated locking devices 12. These locking devices can be replaced by a tubular shaped outer casing that is gradually consumed during the penetrator mode, and from which the submunitions are successively ejected rearwards during the distribution mode.

Figure 7:
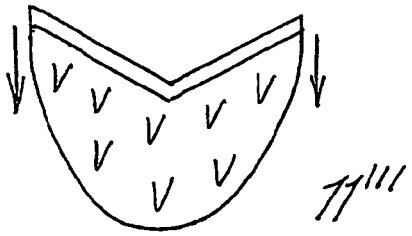
FIG. 7 is a general horizontal view showing a missile in separation mode with a submunition leaving the missile during separation.

FIG. 7 shows a submunition 11'" released from cargo device 1""". It has been ejected rearwards from the tubular shaped carrier fuselage. Symbolically designated locking devices 12' are also shown in open or release position.

Figure 8:
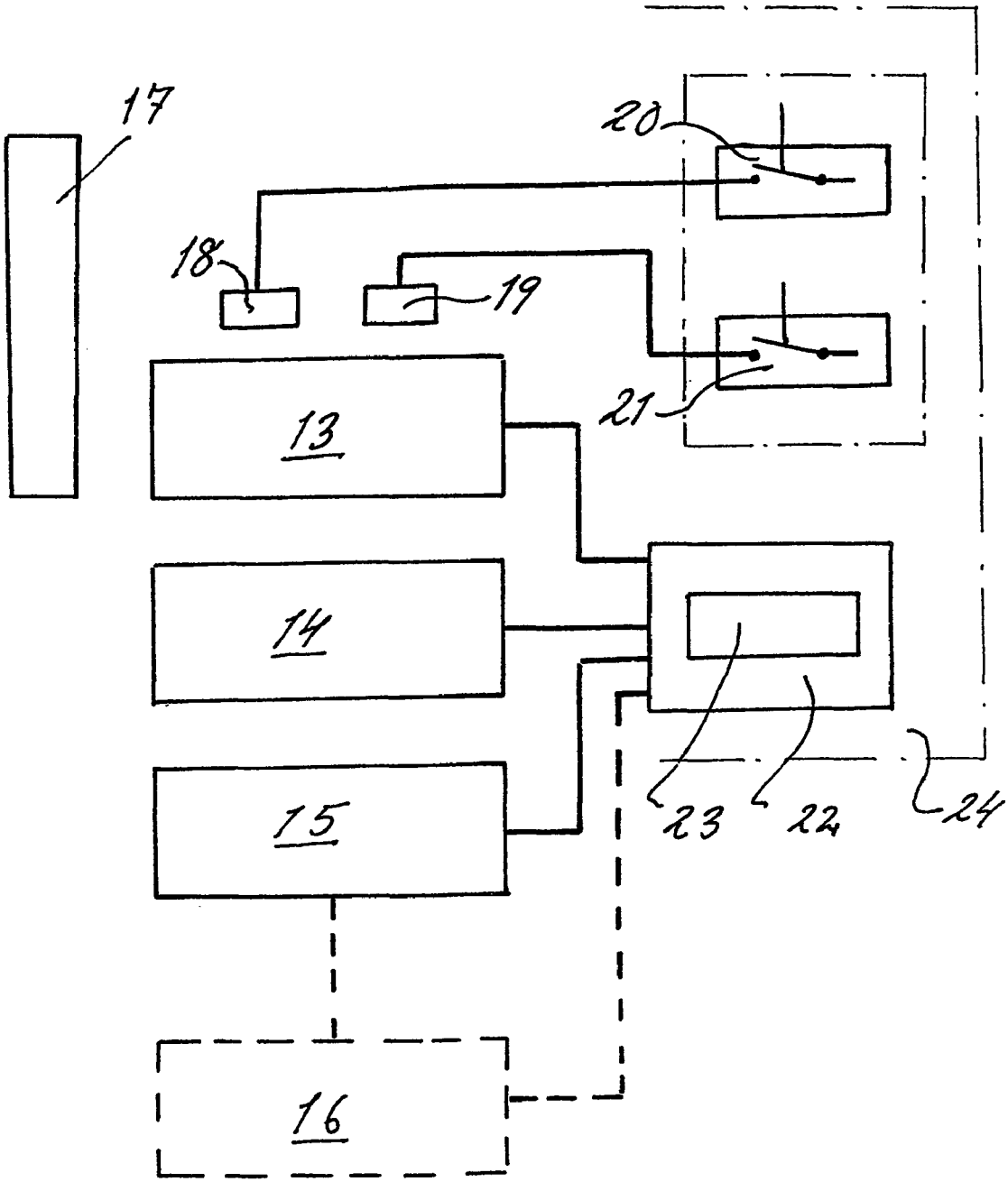

In FIG. 8 a number of submunitions 13, 14, 15, 16 are arranged in a symbolically displayed unit 17. FIG. 8 also includes symbolically illustrated locking devices 18 and 19. Locking device 18 is controllable from a control unit 20 which, when in non-actuated mode, keeps the locking devices open thereby enabling the above mentioned separation mode. For closed mode an actuation signal is received that actuates locking device 18 which thereby prevents the submunitions from leaving the cargo device 17, thus enabling penetrator mode. Locking device 19 operates in the same way as locking device 18 in the distributed penetrator mode. Locking device 19 is controllable from control unit 21. A programming device is designated 22, and there is a control unit designated 23 to control the programming device. The programming device in question is used to determine the triggering and actuation functions for the submunitions. The above mentioned control unit can be incorporated in a common unit 24.

Figure 9:
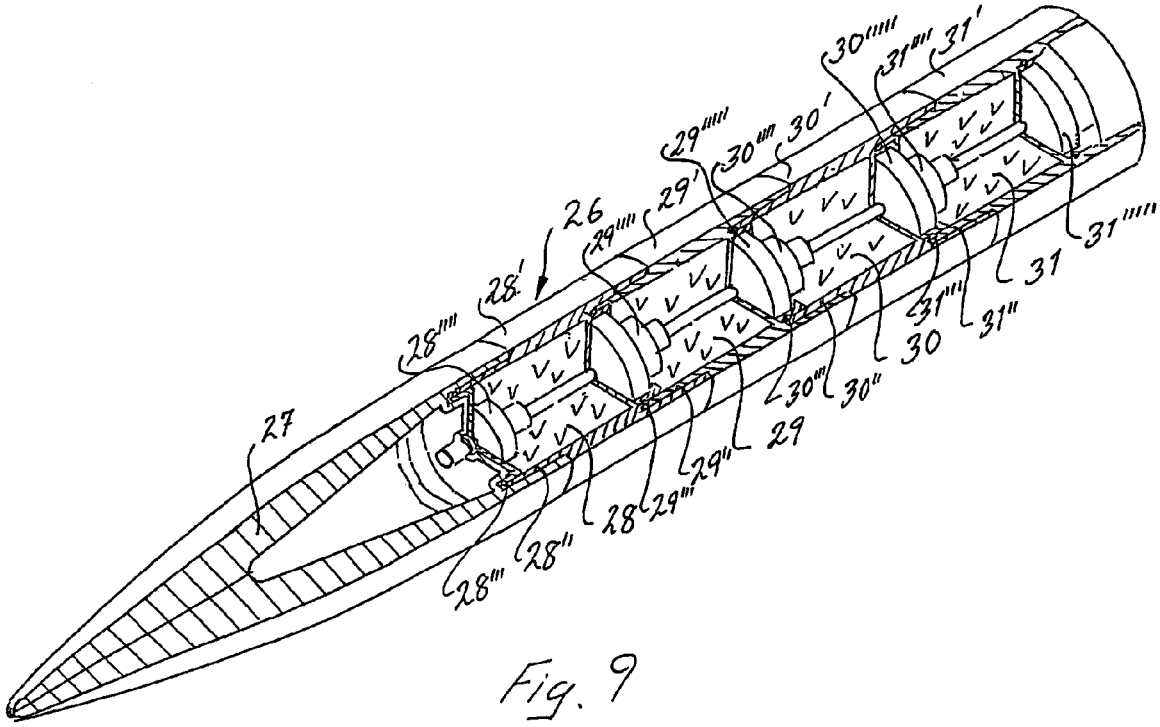
FIG. 9 is a partially cut-away longitudinal section showing the conjoined arrangement of the submunitions necessary for the penetrator mode together with their reinforced nose section.

The four tightly conjoined identical submunitions 28–31 illustrated in FIG. 9 for effecting the penetrator mode constitute a body 26 with a strongly reinforced nose section 27. In the version illustrated each of these submunitions has a strong tubular shaped outer casing generally designated 28'–31', where each outer casing has a somewhat thinner walled front section 28"–31" that is bevelled under the rear section of the rear casing wall of the preceding submunition. The submunitions are conjoined by modified ball catches 28'"–31'" and are further equipped with integral initiation functions 28""–31"" that have the dual task of releasing the submunitions from each other in separation mode. Instead of the version illustrated in FIG. 9 with the tubular outer bodies of the submunitions divisible into several units 28'–31', all the submunitions incorporated can be housed in a separate uniform tubular outer casing from which they are ejected rearwards in separation mode via the rear end of the cargo device relative to its direction of flight. In addition, each submunition has a parachute pack herein designated 28'""–31'"" (refer also to FIG. 10 in which the parachute has deployed after completion of the separation mode). As shown in FIG. 9 each submunition 28–31 is filled with explosive.

Figure 10:
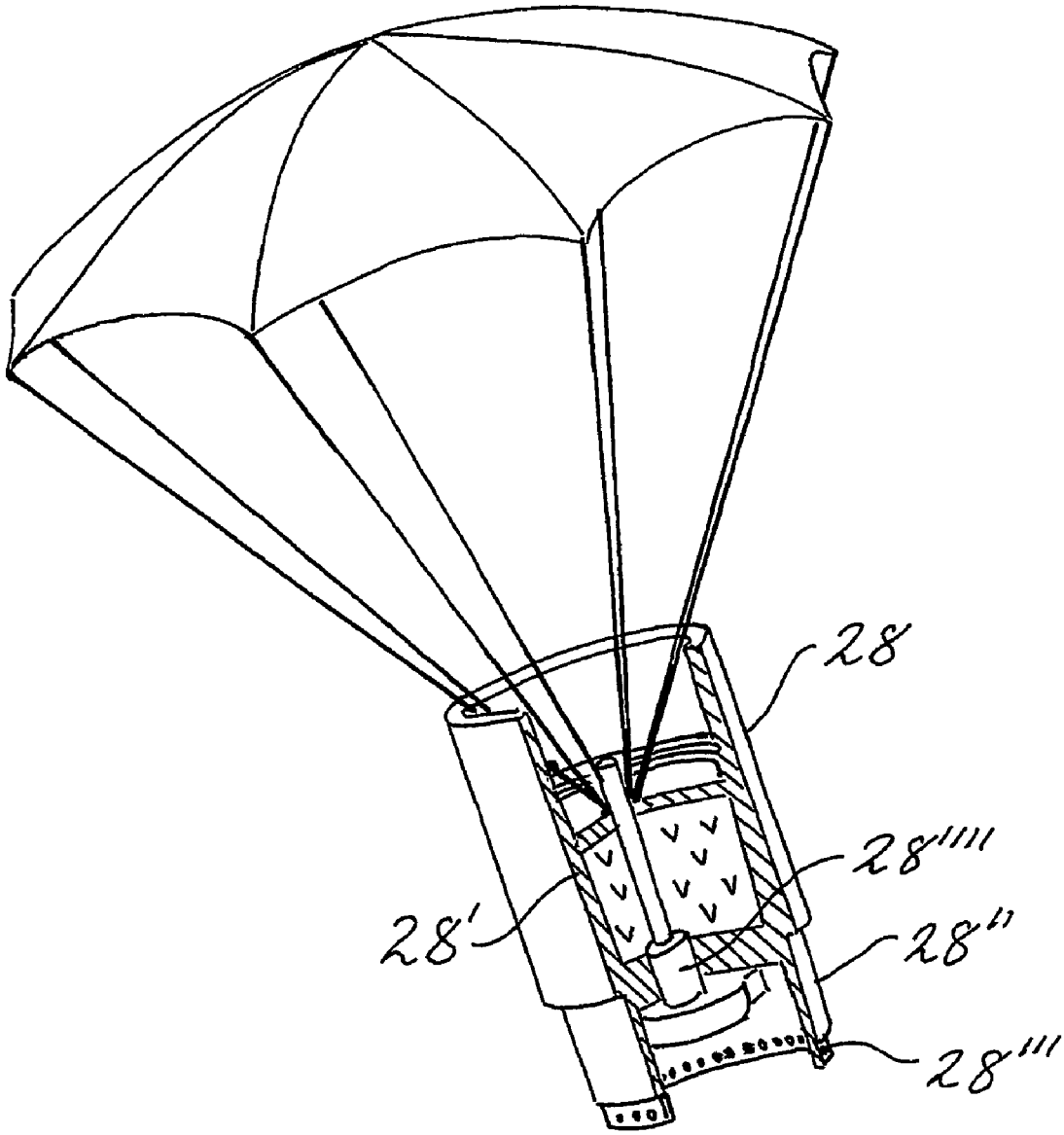
FIG. 10 is a partially cut-away section showing one of the submunitions after it has left the cargo device and is on its way to the target.

FIG. 10 shows submunition 28 suspended from its parachute after a completed separation mode, descending towards the target zone where it will be triggered either by impact or by another—admittedly known—initiation function.

The present invention is not limited to the design examples illustrated above, but can be subjected to modifications within the framework of the subsequent patent claims and the invention concept.

We hereby claim and desire to secure by Letter Patent the following:

1. A multi-mode missile, comprising:

a plurality of submunitions;

a mode setting device which sets an operating mode of the plurality of submunitions contained in the multi-mode missile to selectively be in one of a penetrator mode, a distributed penetrator mode, or a separation mode, wherein, in the penetrator mode, the plurality of submunitions are essentially conjoined in a common triggering arrangement, wherein, in the distributed penetrator mode, the plurality of submunitions are subjected to a relatively minor dispersion with respect to each other and are actuated in sequence as a penetration of a target comprising plural confined spaces progresses, wherein, in the separation mode, the plurality of submunitions sequentially leave the missile in a relatively large dispersal pattern and are thereafter individually actuated by a plurality of associated fazes each selected from the group consisting of an impact fuze, a proximity fine, and a time fine;

one or more triggering devices which detonates one or more of the plurality of submunitions; and means for programming the mode setting device, wherein the means for programming the mode setting device receives an actuation signal via a communications link.

2. The missile of claim 1, further comprising means for dispersing the plurality of submunitions when the separation mode is set.

3. The missile of claim 1, wherein the plurality of submunitions are actuated by an impact fuze.

4. The missile of claim 1, wherein the plurality of submunitions are actuated by a proximity fuze.

5. The missile of claim 1, wherein the plurality of submunitions are actuated by a time fuze.

6. The missile of claim 1, wherein the means for programming the mode setting device interacts with the mode setting device which dependent on at least one manual or automatic actuation, cause the missile and the plurality of submunitions to operate in the penetrator mode in which the plurality of submunitions are conjoined and commonly triggered.

7. The missile of claim 1, wherein the distributed penetrator mode is suitable for actuation against a target comprising plural confined spaces, wherein the plurality of submunitions are sequentially triggered in various ones of the plural confined spaces of the target during penetration of walls, ceilings, or floors of the confined spaces by the multi-mode missile.

8. The missile of claim 1, wherein the penetrator mode is suitable for actuation against a precision target in which a target penetration is an objective.

9. The missile of claim 1, wherein the means for programming the mode setting device interacts with the mode setting device dependent on at least one manual or automatic actuation to cause the missile and the plurality of submunitions to operate in the separation mode in which the plurality of submunitions sequentially leave the missile and thereafter are each actuated by associated individual triggers, each of the associated individual triggers being either independent from or coordinated with the associated individual triggers of the other submunitions.

10. The missile of claim 1, wherein the mode setting device is arranged, dependent on a further actuation, to enable the plurality of submunitions to operate in the distributed penetrator mode in which the plurality submunitions achieve a minor sequential dispersion relative to each other and are actuated as target penetration by the missile progresses.

11. The missile of claim 1, wherein the separation mode is suitable for actuation against a dispersed target.

12. The missile of claim 1, wherein the submunitions are conjoined by a retentive tubular body comprising a plurality of parts joined together with each other in both the penetrator mode and in the separation mode until a dispersal point is reached in the separation mode.

13. The missile of claim 1, wherein, when the plurality of submunitions are in the penetrator mode and after a target is penetrated, the one or more triggering devices are programmed to detonate the plurality of submunitions after penetration is achieved.

14. The missile of claim 1, wherein, when a target impact is achieved without a complete target penetration, the one or more triggering devices are programmed to detonate the plurality of submunitions in conjunction with the target impact.

15. The missile of claim 1, wherein the plurality of associated fuzes are independently triggered.

16. The missile of claim 1, wherein the plurality of associated fuzes are commonly triggered.

17. The missile of claim 1, wherein the plurality of associated fuzes are sequentially triggered.

* * * * *